US006266633B1

(12) United States Patent
Higgins et al.

(10) Patent No.: US 6,266,633 B1
(45) Date of Patent: Jul. 24, 2001

(54) NOISE SUPPRESSION AND CHANNEL EQUALIZATION PREPROCESSOR FOR SPEECH AND SPEAKER RECOGNIZERS: METHOD AND APPARATUS

(75) Inventors: Alan Lawrence Higgins; Steven F. Boll; Jack E. Porter, all of San Diego, CA (US)

(73) Assignee: ITT Manufacturing Enterprises, Wilmington, DE (US)

( * ) Notice: Subject to any disclaimer, the term of this patent is extended or adjusted under 35 U.S.C. 154(b) by 0 days.

(21) Appl. No.: 09/218,565

(22) Filed: Dec. 22, 1998

(51) Int. Cl.[7] ..... G10L 21/02
(52) U.S. Cl. ..... 704/224; 704/228
(58) Field of Search ..... 704/224, 228

(56) References Cited

PUBLICATIONS

Stockham, Jr., Thomas G., Cannon Thomas M., and Ingebretsen, Robert B., "Blind Deconvolution through Digital Signal Processing", Proceedings of the IEEE, vol. 63, No. 4, Apr. 1975, pp. 678–692.
Boll, Steven F., "Suppression of Acoustic Noise in Speech Using Spectral Subtraction", *IEEE Transactions on Acoustics, Speech, and Signal Processing*, vol. ASSP–27, No. 2, Apr. 1979, pp. 113–120.
Avendano, Carlos and Hermansky, Hynek, "On the Effects of Short–Term Spectrum Smoothing in Channel Normalization", *IEEE Transactions on Speech and Audio Processing*, vol. 5, No. 4, Jul. 1997, pp. 372–374.
Hynek Hermansky, et al. "RASTA Processing of Speech", IEEE Trans. Speech and Audio Processing, vol. 2, No. 4, pp. 578–589, Oct. 1994.*
Johan de Veth, et al. "Comparison of Channel Normalisation Techniques for Automatic Speech Recognition over the Phone," Proc. Intl. Conf. on Spoken Language, ICSLP 96, vol. 4, pp. 2332–2335, Oct. 1996.*
Detlef Hardt, et al. "Spectral Subtraction and RASTA–Filtering in Text–Dependent HMM–Based Speaker Verification," Proc. IEEE ICASSP 97, vol. 2, pp. 867–870, Apr. 1997.*
Carlos Avendano, et al. "On the Effedts of Short–Term Spectrum Smoothing in Channel Normalization," IEEE Trans. Speech and Audio Processing, vol. 5, No. 4, pp. 372–374, Jul. 1997.*
Zhang Zhijie, et al. "Stabilized Solutions and Multiparameter Optimization Technique of Deconvolution," Proc. Intl. Conf. Signal Processing, ICSP 98, vol. 1, pp. 168–171, Oct. 1998.*

* cited by examiner

*Primary Examiner*—Tālivaldis I. Šmits
(74) *Attorney, Agent, or Firm*—Arthur L. Plevy; Duane, Morris & Hecksher

(57) ABSTRACT

A method for performing noise suppression and channel equalization of a noisy voice signal comprising the steps of sampling the noisy voice signal at a predetermined sampling rate $f_s$; segmenting the sampled voice signal into a plurality of frames having a predetermined number of samples per frame, over a predetermined temporal window; generating an N-point spectral sample representation of each of the sample signal frames; determining the magnitude of each of the N-point spectral samples and generating a histogram of the energy associated with each of the N-point spectral samples at a particular frequency; detecting a peak amplitude of the histogram which corresponds to a noise threshold $N_f$ associated with the particular frequency; determining a channel frequency response $C_f$ associated with the particular frequency by determining a geometric mean over all the spectral samples having magnitude exceeding the noise threshold $N_f$; subtracting from each of the magnitudes of the N point spectral samples the noise threshold $N_f$ to provide a noise suppressed sample sequence; applying blind deconvolution to the noise suppressed samples; transforming the deconvolved noise suppressed sampled sequence to a temporal representation; shifting the temporal sample sequence in time by a predetermined amount; and adding the time shifted temporal samples over a period corresponding to the predetermined temporal window to provide a suppressed noise voice signal.

26 Claims, 5 Drawing Sheets

| | | | |
|---|---|---|---|
| " 46 - 79 " | " 64 - 79 " | " 74 - 69 " | " 94 - 67 " |
| " 46 - 97 " | " 64 - 97 " | " 74 - 96 " | " 94 - 76 " |
| " 47 - 69 " | " 67 - 49 " | " 76 - 49 " | " 96 - 47 " |
| " 47 - 96 " | " 67 - 94 " | " 76 - 94 " | " 96 - 74 " |
| " 49 - 67 " | " 69 - 47 " | " 79 - 46 " | " 97 - 46 " |
| " 49 - 76 " | " 69 - 74 " | " 79 - 64 " | " 97 - 64 " |

NOISE SUPPRESSION AND CHANNEL EQUALIZATION PREPROCESSOR FOR SPEECH AND SPEAKER RECOGNIZERS: METHOD AND APPARATUS

FIELD OF THE INVENTION

This invention relates to speech recognition generally, and more particularly to a signal pre-processor for enhancing the quality of a speech signal before further processing by a speech or speaker recognition device.

BACKGROUND OF THE INVENTION

Speech and speaker recognition devices must often operate on speech signals corrupted by noise and channel distortions. This is the case, for example, when using "far-field" microphones placed on a desktop near computers or other office equipment. Noise, such as noise originating from disk drives or cooling fans can be transmitted both mechanically, by direct contact of the microphone to the computer equipment or through the furniture it rests on, and by acoustic transmission through the air. Noise can also be picked up through electrical or magnetic coupling as in the case of power line "hum".

The "channel" through which speech is measured includes the processes of acoustic propagation from the speaker's mouth, transduction by the microphone, analog signal processing, and analog-to-digital conversion. The distortion introduced by this composite channel may be modeled as a linear process and characterized by its frequency response. Factors affecting the channel frequency response include microphone type, distance and off-axis angle of the speaker relative to the microphone, room acoustics, and the characteristics of the analog electronic circuits and anti-aliasing filter.

Speech and speaker recognition systems operate by comparing the input speech with acoustic models derived from prior "training" speech material. Loss of accuracy occurs when the input speech is corrupted by noise or channel frequency response that differ significantly from those affecting the training speech. The present invention addresses this problem by suppressing noise and equalizing channel distortions in an input speech signal.

Certain methods for noise suppression are well known. One method used for noise suppression is known as spectral subtraction (SS). SS requires an estimate of the noise magnitude spectrum, which is assumed to be stationary over time. This estimate is subtracted from the measured magnitude spectrum of a noisy speech input at each time interval or "frame" to obtain an estimate of the magnitude spectrum of the speech in the absence of noise. Further details regarding noise suppression may be obtained from the publication entitled "Suppression of acoustic noise in speech using spectral subtraction," *IEEE Transactions on Acoustics, Speech, and Signal Processing,* vol. ASSP-27, no. 2, pp. 113–120, IEEE, New York, N.Y., 1979, and incorporated herein by reference.

Certain methods which operate to perform channel equalization are also known. One method used for channel equalization, known as blind deconvolution (BD), estimates the spectrum of the input signal over its whole duration and applies a linear filter designed to make the spectrum of the signal equal to the long term spectrum of speech. This method effectively compensates for the channel when the input speech material is of sufficient length that its spectrum approximates the long-term spectrum of speech. Further details regarding Blind Deconvolution will be obtained from the publication by T. G. Stockham, T. M. Cannon, and R. B. Ingebretsen, entitled "Blind deconvolution through digital signal processing," *Proceedings of the IEEE,* vol. 63, No. 4 pp. 678–692, 1975, incorporated herein by reference.

In addition, a publication by D. Hardt and K. Fellbaum, entitled "Spectral Subtraction and RASTA Filtering in Text-Dependent HMM-Based Speaker Verification", IEEE Doc. No. 0-8186-7919-0/97, p ICASSP 97, Munich, Germany, April, 1997 and incorporated by reference herein describes a comparison of speaker verification performance using "internal" versus "external" spectral subtraction. Internal SS, integrated with an existing verifier front end system, was found to be inferior to external SS, which was implemented as an independent processing step, prior to input to the verifier. Using external SS, verification accuracy was found to improve with increasing spectral analysis window size up to 128 milliseconds. Such findings were confirmed in a set of experiments involving the SpeakerKey voice verifier system described in commonly assigned copending patent application Ser. No. 08/960,509 entitled "VOICE AUTHENTICATION SYSTEM" filed on Oct. 29, 1997 to Blais et al, and incorporated herein by reference, and a specially-collected database using far-field microphones. In our experiments, the improvement with increasing window size was found to be related to the nature of the noise. The loudest noise components in the data are stationary, narrow bandwidth spectral lines, for which estimation accuracy increases with window length. High spectral resolution is therefore needed to reject this type of noise. Analysis windows of 128 ms length are sufficient to provide the needed resolution.

In another publication by C. Avendano and H. Hermansky entitled "On the Effects of Short-Term Spectrum Smoothing in Channel Normalization", 5, p. 372, *IEEE Transactions on Speech and Audio Processing,* vol. 5, No. 4, July, 1997, an improvement to the performance of blind deconvolution was reported in the context of a speech recognition system. The system used measurements of the power spectrum in critical bands, where each such measurement was derived by integrating the fast Fourier transform (FFT) power spectrum over frequencies within the critical band. BD was reported to perform better when applied prior to critical-band integration (i.e., to the FFT power spectrum) than after (to the critical band measurements). The disparity of performance was greatest for channels whose magnitude response varies for channels whose magnitude response varies within the frequency limits of the individual critical band filters. In the present invention, it was found that increasing the window size from 20 ms (typically used in speech and speaker recognition systems) to 128 ms led to additional performance improvements. The reason for this improvement is similar to that offered above in connection with narrow bandwidth noise. It is known that reverberant environments can introduce sharp spectral nulls (as narrow as 10 Hz in width) in the frequency response of acoustic transmission from the talker to the microphone caused by interference between direct and reflected signal paths. These effects cannot be adequately compensated if BD is applied to critical bands, whose bandwidths greatly exceed 10 Hz. When applied before critical band integration, spectral nulls present in the channel can be resolved if sufficiently long analysis windows are used. Windows of at least 100 ms length are required to provide the needed 10 Hz frequency resolution.

However, none of the prior art applications combines noise suppression with channel equalization, including channel frequency response normalization and signal level normalization to a signal preprocessor apparatus which accepts as input a noisy speech signal such as that introduced from a microphone and which produces an enhanced output speech signal for subsequent processing.

SUMMARY OF THE INVENTION

Figure 1:
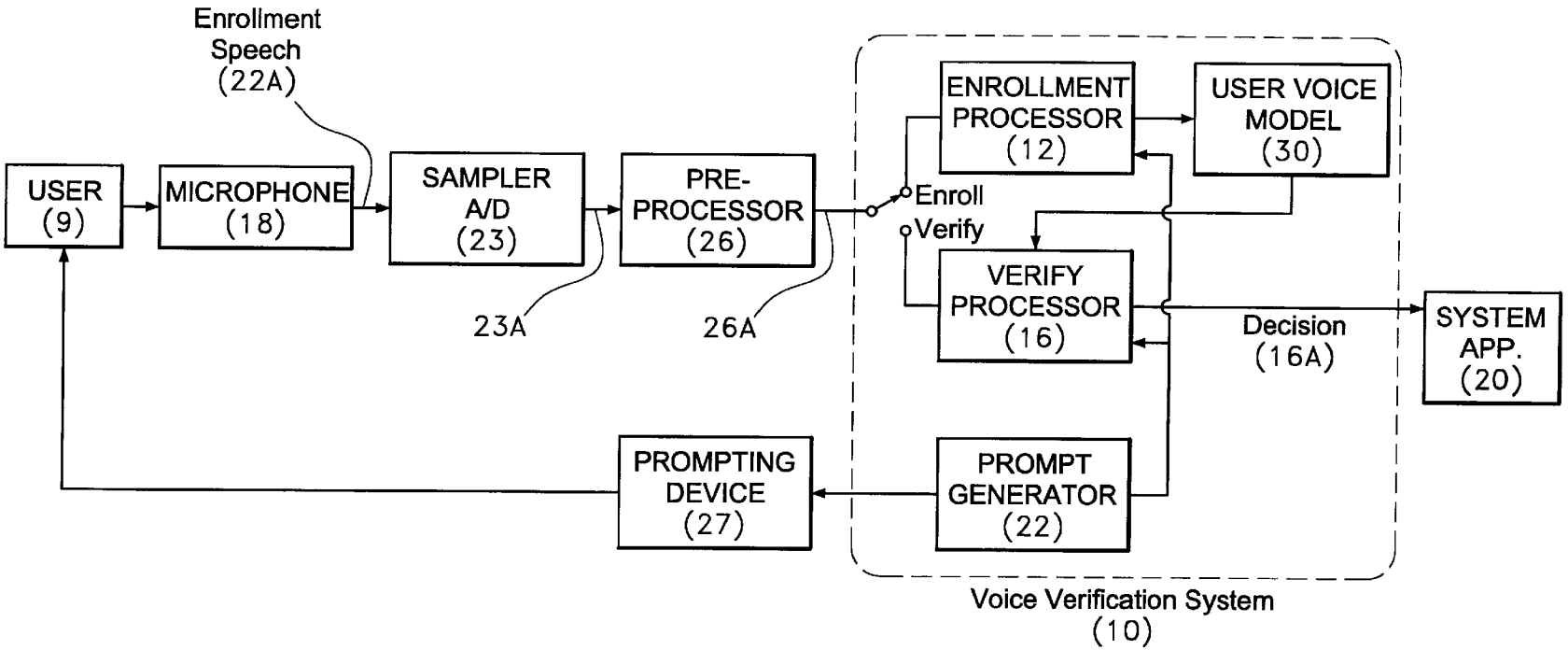
FIG. 1 is an exemplary illustration of a voice verification system employing the preprocessor according to the present invention.

It is an object of the present invention to provide a signal pre-processor which accepts as input a speech signal from a microphone or other source and produces as output an enhanced speech signal for subsequent processing by a speech or speaker recognition device. It is intended to be used both in processing training material and at recognition time by attenuating stationary noise that may be present in the input signal and applying linear filtering to make the long-term spectrum associated with the output signal equal to a pre-specified "target" spectrum. Through these operations, differences in noise and frequency response between training and test channels are effectively suppressed, minimizing the loss of recognition or verification accuracy.

It is a further object of the invention to provide a method for performing noise suppression and channel equalization of a noisy voice signal comprising the steps of sampling the noisy voice signal at a predetermined sampling rate $f_s$; segmenting the sampled voice signal into a plurality of frames having a predetermined number of samples per frame, over a predetermined temporal window; generating an N-point spectral sample representation of each of the sample signal frames; determining the magnitude of each of the N-point spectral samples and generating a histogram of the energy associated with each of the N-point spectral samples at a particular frequency; detecting a peak amplitude of the histogram which corresponds to a noise threshold $N_f$ associated with the particular frequency; determining a channel frequency response $C_f$ associated with the particular frequency by determining a geometric mean over all the spectral samples having magnitude exceeding the noise threshold $N_f$; subtracting from each of the magnitudes of the N point spectral samples the noise threshold $N_f$ to provide a noise suppressed sample sequence; applying blind deconvolution to the noise suppressed samples; transforming the deconvolved noise suppressed sampled sequence to a temporal representation; shifting the temporal sample sequence in time by a predetermined amount; and adding the time shifted temporal samples over a period corresponding to the predetermined temporal window to provide a suppressed noise voice signal.

DETAILED DESCRIPTION OF THE INVENTION

Before embarking on a detailed discussion, the following should be understood. The pre-processor according to the present invention combines spectral subtraction and blind deconvolution within a common algorithmic framework. It also normalizes the peak energy of the output speech signal to a fixed value prior to verification. The latter operation reduces saturation and quantization effects induced by input signals with large dynamic range.

The preprocessor according to the present invention is especially useful since a combination of noise and channel variability is frequently encountered when using far-field microphones. In many applications of practical interest, both the noise spectrum and the channel frequency response exhibit sharp peaks and nulls as a function of frequency. These problems are not effectively treated in conventional speech and speaker recognition systems, where the tradeoff between time and frequency resolution is heavily influenced by the need to measure speech events of short duration. From the description that follows, one can see that the preprocessor of the present invention addresses noise and channel variability problems simultaneously, using an efficient frequency-domain approach that provides sufficient frequency resolution of spectral peaks and nulls.

The invention has been found to be particularly effective when used in conjunction with the SpeakerKey voice verification system as disclosed in U.S. Pat. No. 5,339,385 by A. L. Higgins, entitled SPEAKER VERIFIER USING NEAREST-NEIGHBOR DISTANCE MEASURE, issued on Aug. 16, 1994, and commonly assigned copending applications Ser. Nos. 08/960,509 and 08/632,723, now U.S. Pat. No. 5,937,381. SpeakerKey uses prompted phrases that are constructed in a manner that enables blind deconvolution to provide accurate channel estimates, even for short phrases. In experiments involving the SpeakerKey system with far-field microphones, error rates were reduced by at least half under a variety of conditions by using the novel preprocessor apparatus.

Referring now to FIG. 1, there is shown a voice verification system 10 in which the output of the preprocessor 26, according to the present invention, is utilized. Note that when referring to the drawings, like reference numerals are used to indicate like parts. A voice verification system such as that disclosed in copending, commonly assigned patent application Ser. Nos. 08/960,509, 08/632,723, or issued U.S. Pat. No. 5,271,088, and incorporated herein by reference, may use and/or implement the preprocessor according to the present invention, in order to provide noise suppression, channel equalization, and normalization of an noisy voice signal prior to the step of verifying the voice signal. As shown in FIG. 1 , the voice verification system 10 includes a prompt generator 22, which produces a prompting message and communicates it to the user 9 via prompting device 27. The prompting message may be communicated aurally by means of a computer monitor. In response to the prompt, a user 9 speaks into a microphone 18, thereby producing enrollnent speech utterances 22A. Speech utterances 22A are input to analog to digital converter circuit 23 which performs sampling at a rate of preferably fs=8000 Hz (i.e. 8 KHz) to provide a digitized voice signal 23A for input to preprocessor 26, which will be described in detail below. The output of preprocessor 26 is applied as input to either enrollment processor 12 or verification processor 16 of voice verification system 10. The enrollment processor 12 performs an enrollment function by generating a voice model 30 of an authorized user's speech. The voice model 30 is then stored in the computer's memory so that it can be downloaded at a later time by the verification function. The verification processor 16 performs the verification function by first processing the speech of the user, and then comparing the processed speech tot he voice model 30. Based on this comparison, the verification processor produces a decision 16A to either grant or deny the user 9 access to system application 20.

The speech utterances 22A comprise one or more phrases which consist of the same word in different word orders. Such phrases may be selected from the group of enrollment phrases shown in FIG. 5. As one can ascertain, each of the phrases consist of four digits "four", "six", "seven", "nine", connected by "t's" such that a single phrase or speech utterance may be "forty six - seventy nine", or "forty six - ninety seven", and so on. These selectable enrollment phrases or speech utterances are thus limited to the twenty-four combinations of words "four", "six", "seven" and "nine" arranged in double two-digit number combination. The selection of these enrollment speech utterances allows easy and consistent repetition and minimizes the number of phrases required for enrollment and/or verification. In addition, these phrases represent a small number of words, while enabling accurate word recognition accuracy, and phonetic composition structure to allow channel equalization using blind deconvolution. Note that phrases containing the words "zero", "one", "two", "three", "five" and "eight" are excluded because such numbers introduce pronunciations that depend on the position on the word within the phrase, for example, "20" vs. "2". Note further that while the preferred embodiment uses prompted speech utterances, computerized prompting is not necessary to carry out the present invention.

The preprocessor 26 operates to convert speech utterances into a plurality of speech frames and to extract the spectral characteristics and features of each of the speech frames. The preprocessor 26 utilizes the spectral magnitudes of each of the windowed speech samples 24A (FIGS. 2A, 2B) to perform noise suppression and channel equalization of the magnitude spectra. In general, processing is performed in two passes over the speech data. In the first pass, magnitude spectra are computed and saved for the entire utterance. These magnitude spectra are used to estimate the noise floor for spectral subtraction and the channel frequency response. Once the noise floor, $N_f$, and channel frequency response are obtained, the preprocessor 26 in a second pass, subtracts from each of the magnitude spectra the noise floor and sets any negative results to zero. Blind deconvolution is than applied by multiplying the SS-processed magnitude by the blind deconvolution filter having a frequency response of $GB_f/C_f$, where $B_f$ represents a trapezoidal window applied to the blind deconvolution filter to reject frequencies outside a bandpass range and where G represents a gain constant applied for the purpose of output level normalization. The preprocessor then operates to convert the spectral data back into a temporal representation via an inverse discrete Fourier transform such as an IFFT while maintaining the phase and provides a preprocessed output signal 26A for further processing by a verifying system or construction of a user voice model 30. Note that while in the preferred embodiment, processing is performed over two passes of the data, the present contemplates the use of one pass of speech data in which to perform the preprocessing functions described herein.

Figure 2A:
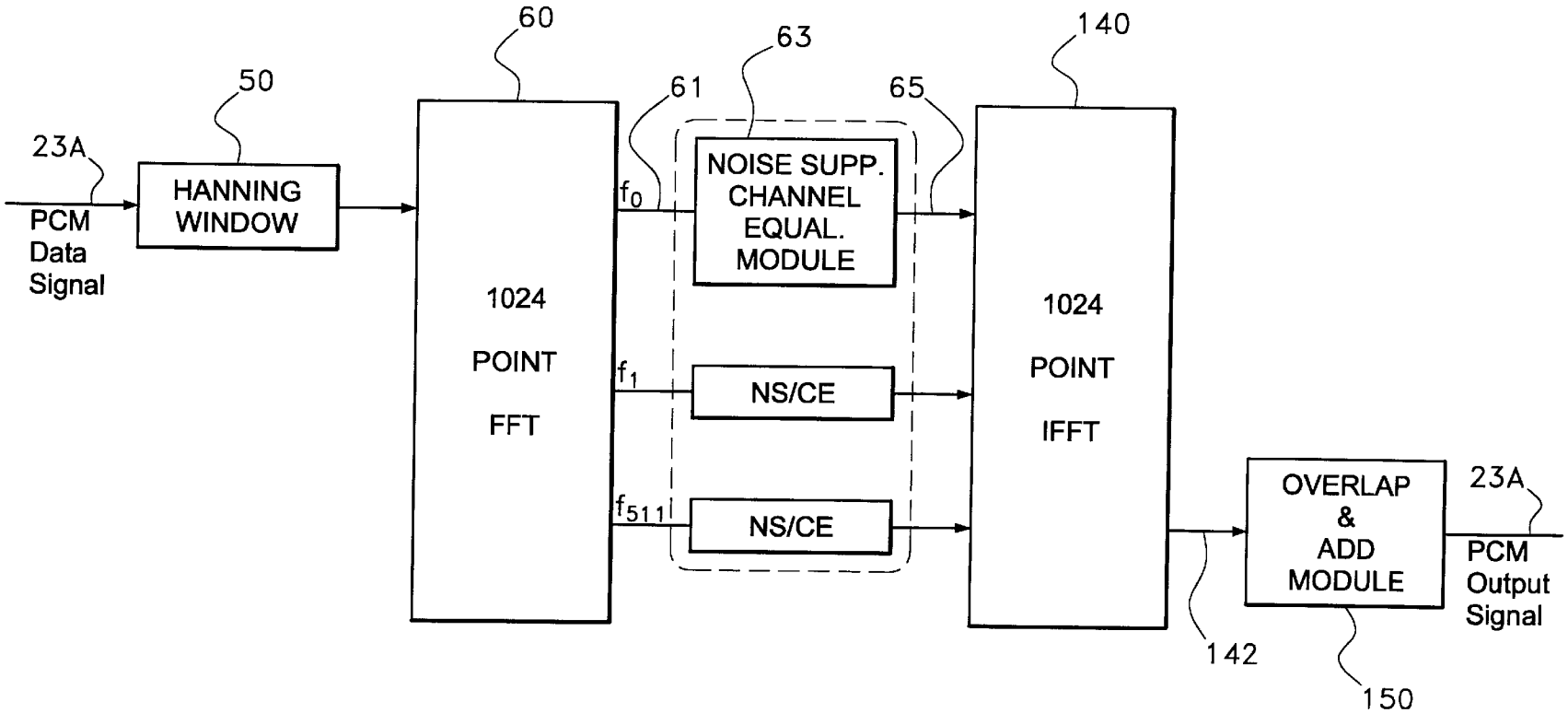
FIG. 2A is a block diagram depicting the major functional components of the preprocessor according to the present invention.

Referring now to FIG. 2A, there is shown a block diagram of the preprocessor 26. Each incoming frame of sampled data 23A indicative of a speech utterance received over an input channel is multiplied by a Hanning window 50 and processed using an FFT 60. The sampled data 23A is indicative of a noisy voice input signal and comprising the speech utterance which has been sampled and digitized at a predetermined sample rate (preferably 8 KHz) via an analog-to-digital (A/D) converter for input to the preprocessor. Preferably, the noisy input voice signal comprises pulse-code modulator (PCM) sampled signal, but may be any of a number of different types of digital signals. The FFT transforms the windowed frame data into a "frequency domain" representation, where further processing represented by module 63 occurs (shown in greater detail in FIG. 2B). In the preferred embodiment, a 1024-point Hanning window 50 and a 1024-point FFT 60 are used. The 1024-point Hanning window processes each speech utterance into a plurality of time windows or speech frames of 1024-point samples, with consecutive frames overlapping by one-half (½) window (i.e. 512 samples). Each windowed frame of data samples 52 is then input into the 1024-point FFT processor 60 for converting the sampled speech signal into a spectral representation sequence having both real and imaginary portions. That is, operation of the FFT 60 produces, for each frame of data, 512 real/imaginary number pairs representing the complex spectrum at the 512 FFT sampling frequencies indicated $f_0, f_i, \ldots f_{511}$. The frequency-domain processing of module 63 is therefore duplicated 512 times, once for each sampling frequency. After frequency-domain processing 63, an IFFT 140 transforms the data back to the time domain, where it is overlapped by one-half frame with the previous output data and added to it. Note that if the frequency-domain processing of module 63 did nothing (i.e., simply passed the signal through unaltered), the output signal 152 of the preprocessor would be identical to the input 23A because of the IFFT 140 and overlap and add synthesizer (OLA) module 150 simply invert the processing performed by the Hanning window 50 and FFT 60.

Figure 2B:
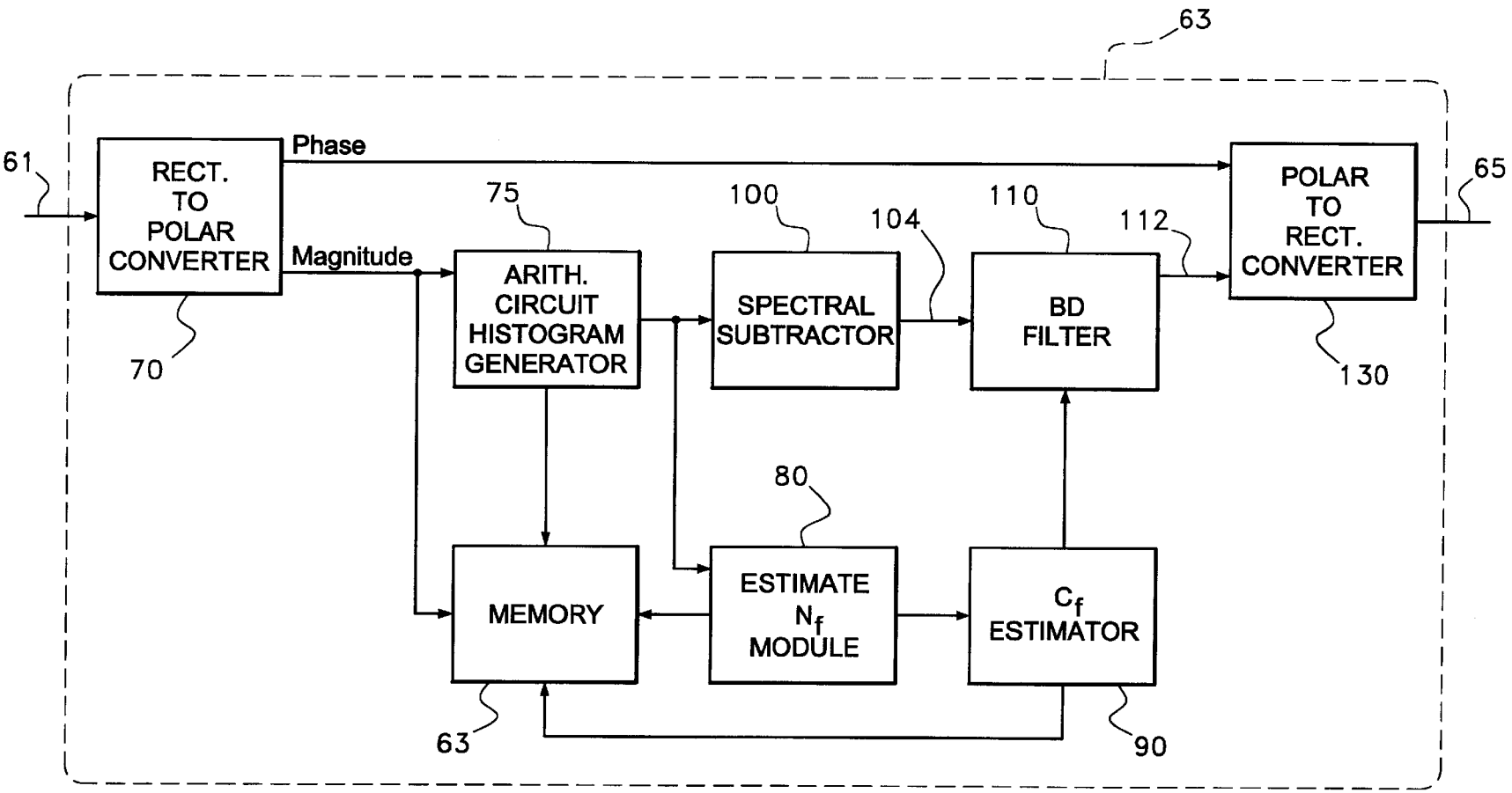
FIG. 2B is a detailed block diagram depicting in greater detail the noise suppression and channel equalization frequency processing module illustrated in FIG. 2A according to the present invention.

Referring now to FIG. 2B, there is shown a block diagram of the frequency-domain processing associated with module 63. Each real/imaginary number pair input 61 from FFT 60 is first converted to a magnitude and phase via polar converter module 70 which operates to convert the Fourier transform spectral sequence from rectangular to polar coordinates using well-known formulas. Such means for converting rectangular to polar coordinates is well known in the art and will therefore not be described in detail. However, software programs may easily implement such conversion by taking square root of the sum of the squares of the real and imaginary portions of the spectral sequence 61 to obtain the magnitude spectra, and where the phase associated with each spectral sample is obtained by taking the arc tangent of the imaginary part over the real part. Processing, to be elaborated on below, is performed on the magnitude portion, leaving the phase portion unaltered. Each magnitude/phase number pair is then converted to a real/imaginary number pair using well-known formulas. These numbers comprise the output of module 63. One can ascertain that if no processing were applied to the magnitude (so that both the magnitude and phase were unaltered) then the output of module 63 would be identical to the input of module 63. In this case, as stated above, the output signal 65 of preprocessor 26 would be identical to its input 61.

Figures 4, 5:
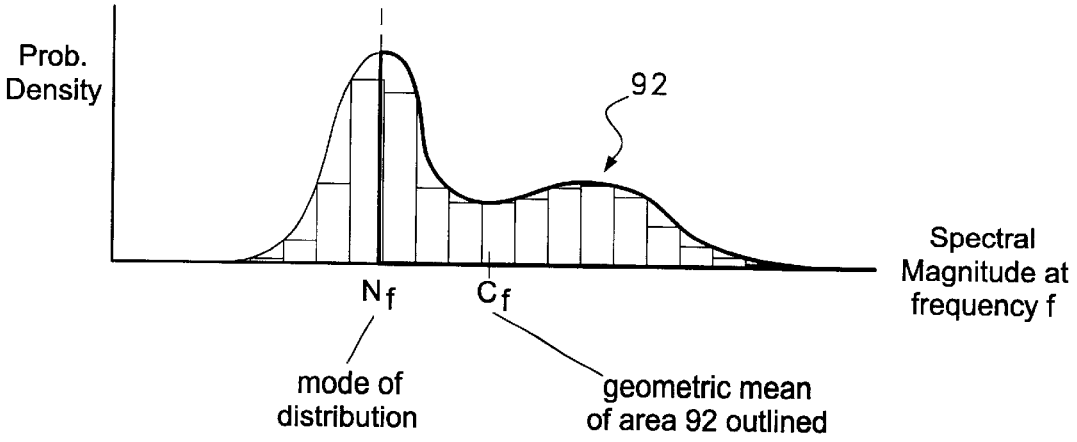
FIG. 4 is an exemplary illustration of a histogram generated for determining the noise floor and channel response in order to perform noise suppression and channel equalization according to the present invention.
FIG. 5 is a chart of speech utterances or phrases processed by the preprocessor according to the present invention.

Still referring to FIG. 2B, the operations performed on the magnitude spectra can be divided into two estimation steps represented by modules 80 and 90, and two processing steps represented by modules 100 and 110. In the preferred embodiment, the estimation steps are carried out using data from the whole utterance. To accomplish this, the data is processed in two passes over the sampled utterance data. In the first pass, magnitude spectra $m_{ft}$ output are computed and saved in memory 14 for the whole utterance. That is, the data $m_{ft}$ output from rectangular to polar converter 50 represents the magnitude at a Fourier frequency f and time window (i.e. frame) t is stored in memory 14 such as a database. Note that in the processing that follows, the phase associated with the spectral samples is unmodified, so that the processing is associated with the FFT magnitude rather than the associated phase. Accordingly, the subsequent processing by polar to rectangular converter 130 and IFFT processor algorithm 140 operates to maintain the original phase of each input sampled speech utterance. Conventional arithmetic circuit 75 operates to construct histograms of the magnitude spectra $m_{ft}$ which are generated for each frequency using each of the frames which comprise a particular utterance and are stored in memory 14. The concept is to determine from the histogram for each frequency bin, what is the noise amplitude over the whole utterance. In each histogram, the background noise becomes evident as a peak or mode within the histogram corresponding to the amplitude of the noise floor at that particular frequency. FIG. 4 provides an example of this. The histogram shown in FIG. 4 represents the probability density as a function of the spectral magnitude at a particular frequency f. The mode of distribution, at $N_f$, is used to estimate the magnitude of the noise floor at frequency f. Conventional detector 80 then operates to examine each of the bins comprising the histogram at frequency f to determine which magnitude bin has the highest probability. Noise floor $N_f$ is then set equal to this magnitude. Once the noise floor, $N_f$, has been determined, channel estimator 90 then operates in response to the detection of the noise floor $N_f$ by averaging the log magnitudes of those frequencies which exceed the noise floor to obtain the channel frequency response $C_f$ at frequency f. In the preferred embodiment, the estimator 90 operates to determine the channel frequency according to the equation $$C_f = \exp\left(\frac{1}{|m_{ft} > N_f|} \sum_{m_{ft} > N_f} \log m_{ft}\right).$$

Thus, the channel frequency response $C_f$ at frequency f is set equal to the geometric mean over the utterance of those magnitudes at frequency f that exceed the noise floor. Note further that $|m_{ft} > N_f|$ equals the number of time windows for which the magnitude at frequency f exceeds the noise floor at frequency f. Each of the noise floor and channel frequency response estimates are stored in memory 14. Spectral subtraction (SS) module 100 then operates on the saved magnitude spectra data and noise estimate by subtracting from each $m_{ft}$ the noise floor $N_f$ determined in module 80 and setting any negative results to zero to provide a noise-suppressed signal sequence 104. Blind deconvolution filter 110 is coupled to the output of SS module 100 and operates by multiplying the SS processed magnitude sequence 104 by the BD filter frequency response. As shown in FIG. 2B, blind deconvolution filter 110 is coupled to the spectral subtractor 100 and has a BD filter frequency response $H_f = GB_f/C_f$ which is inversely proportional to the channel frequency response. Preferably, the BD filter comprises a trapezoidal window with height, $B_f$, applied to the filter to reject frequencies outside a band pass range where

| | | |
|---|---|---|
| $B_f =$ | 1 | if $L_1 < f < H_1$ |
| | 0 | if $f < L_0$ or $f > H_0$ |
| | $(f - L_0)/(L_1 - L_0)$ | if $L_0 < f < L_1$ |
| | $(H_0 - F)/(H_0 - L_1)$ | if $H_1 < f < H_0$ |

In the preferred embodiment, the parameters are $L_0$=200 Hz, $L_1$=300 Hz, $H_0$=3200 Hz, and $H_1$=3450 Hz. The gain constant, G, is applied for the purpose of output level normalization $$G = \frac{P}{\max_t \sqrt{\sum_f \left(m_{ft} \frac{B_f}{C_f}\right)^2}}$$

where P is the desired peak RMS value of the output signal. Note that operations 75, 80, 90, 100, and 110 are repeated for each of the 512 values of f corresponding to analysis frequencies of the FFT. The spectral data sequence 112 output from the blind deconvolution filter is then converted back to rectangular coordinates via polar rectangular converter 130 (which is the inverse of module 70), the output of which is coupled to a 1024 point inverse fast Fourier transform algorithm module 140 (FIG. 2) which operates to provide a temporal representation associated with each of the framed sequences and which maintains the original phase associated with the data. Module 150 implements standard "overlap-and-add" synthesis, and operates by shifting the temporal data sequence 142 by an amount corresponding to the overlap indicated in the Hanning window 50 and accumulates the time shifted samples over a period corresponding to the Hanning window to provide a normalized, noise suppressed, and channel equalized PCM output for further processing by a verifier or for use in constructing voice models of the user.

Figure 3:
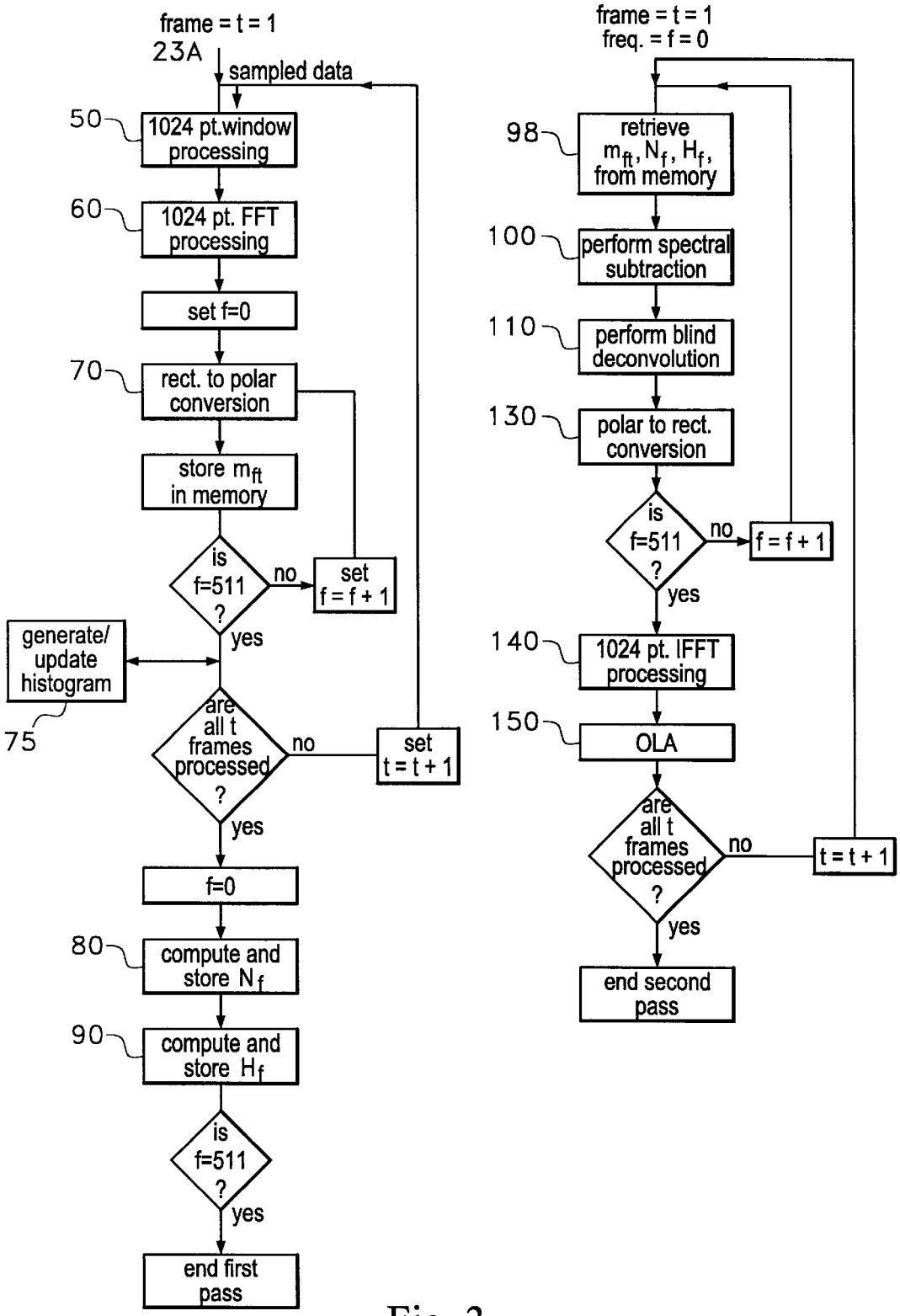
FIG. 3 is a flow diagram depicting the processing steps associated with noise suppression and channel equalization of a noisy input voice signal according to the present invention.

The following is intended as an exemplary illustration of the processing depicted in FIGS. 2A, B, and FIG. 3 using typical parametric values. As shown in FIGS. 2A, 2B, each frame is transformed using a 1024-point FFT and rectangular to polar conversion into a magnitude and phase at each of the 512 sampling frequencies. The sampling frequencies are multiples of 8000/1024, or about 7.8 Hz. If one assumes that there are t frames at a sampling frequency of 8000 Hz and using one-half overlapped 1024 sample windows, a three second speech utterance would have 3×8000/512 or about 46 frames. The spectral magnitudes $m_{ft}$ are then computed and stored for each of the frequencies f=0,1, . . . 511 and frame t=1,2, . . . 46. In this example, there are a total of 512×46 or 23,552. The processing next determines the noise floor and channel response which are performed separately and independently of each sampling frequency. For example, at a particular frequency, $f_0$, the 46 values of $M_{ft}$ for $f=f_0$, and t=1,2, . . . ,46 are calculated to form a histogram. From this, the noise magnitude $N_S$ and channel frequency response $C_f$ at frequency $f_0$ is then estimated. These steps are repeated 512 times—once for each frequency.

FIG. 3 depicts a flow chart illustrating the detailed computation involved in each of the processing passes described in the apparatus illustrated in FIGS. 2A and B. Referring now to FIG. 3 in conjunction with FIGS. 2A and B, at a first pass the magnitudes computed by module 70 are stored in memory 14 for the whole utterance. This requires steps 50 and 60 (windowing and FFT processing) to be performed for each frame t of sampled data, and module 70 (rectangular to polar conversion) to be performed for each frame t and each frequency f. The magnitudes $m_{ft}$ are stored in memory for each FFT frequency f and each frame t. Note that if all frames in an utterance have not been processed (module 74), processing returns to module 50 for further processing of additional speech frames. When all of the frames associated with a particular utterance have been processed, a histogram of the magnitudes of the samples is then generated at each frequency f (module 75). Processing then proceeds to determining the noise floor associated with a particular frequency by determining the peak amplitude of the histogram at each frequency. The noise floor $N_f$ is then set equal to the mode of this histogram. The channel frequency response $C_f$ is then computed (module 90) by determining the geometric mean over the utterance of those magnitudes at frequency f that exceed the noise floor $N_f$. The estimation steps 80 and 90 are performed at each frequency using the stored magnitudes $m_{ft}$. The results of steps 80 and 90 ($N_f$ and the BD filter and $H_f=G*B_f/C_f$) are also stored in memory.

In the second pass, the magnitude spectra are retrieved from memory (step 98), and the estimation steps 100 and 110, as well as conversion step 130, are performed for each frame and each frequency. The inverse FFT 140 and overlap-and-add synthesis 150 processing steps are performed for each frame.

Still referring to FIG. 3, the processing steps associated with the second pass is as follows. Upon determining the channel frequency response $C_f$ (and thus $H_f$), processing continues by performing spectral subtraction 100 which subtracts from each $m_{ft}$ the noise floor $N_f$ and sets any negative results to zero. Blind deconvolution is then performed on the noise suppressed output data 104 by multiplying the SS processed magnitude signal 104 by the filter 110 with frequency response $H_f=GB_f/C_f$. Note that in the preferred embodiment, the term $B_f$ rejects frequencies outside a bandpass range, and gain constant G is applied for the purpose of output normalization and having a value previously described. The deconvolved sample sequence 112 output from module 110 is then converted from polar coordinates back to rectangular coordinates via module 130 and an IFFT is performed (module 140) which maintains the original phase to provide a temporal representation of the data. The output of the IFFT is then overlapped and added to the previous output according to conventional overlap-and-add method, and then supplied and output as signal 152 for input to a verifier processor or another processing device, for further processing, including the construction of voice model. Note further that the spectral subtraction processing occurring in module 100 operates to subtract or strip away the noise component from the signal at each FFT analysis frequency. Note that, the processing described herein assumes that the noise is stationary; that is, the noise spectrum is assumed to not change over time.

Note that in the preferred embodiment illustrated in FIGS. 2A, B and 3, , an 8 kHz sampling rate, $f_s$ is used in conjunction with the 1024 point Hanning window having ½overlap and 1024 point FFT/IFFT algorithms to enable effective noise suppression. The use of this longer window (i.e. 128 msec.) coupled with the use of a 1024 point fast Fourier transform (as opposed to a 512 or 2048 point FFT, for example) allow for effective cancellation of stationery, coherent noise such as that produced by cooling fans, disk drives, or other mechanical devices. Shorter windows are found to not present an effective medium for noise reduction, since the goal is to reduce the noise level which manifests a coherency over a relatively long period of time. Thus, longer analysis windows (greater than 1000 points) are used according to the present invention to provide a 10 Hz or less frequency resolution and to provide effective noise cancellation. These same motivations apply also to channel equalization. The use of 1024-point windows and FFTs enables the preprocessor to effectively cancel narrow spectral peaks and nulls as produced by multi-path acoustic interference.

Note also that in determining the peak amplitude associated with the histogram to enable calculation of the noise floor, conventional smoothing operations and/or filtering operations may be performed to help determine the appropriate noise magnitude. In addition, the histogram processing occurs on a frequency-by frequency basis, where each histogram represents magnitudes $m_{ft}$ for a particular value of f, and all frames t in the utterance. Note further that module 150 operates on each of the temporal frames output from the IFFT module 140 and operates to shift (i.e. delay) and add each of the windowed frames to produce the PCM output signal 152 for processing. As one can ascertain, no output is generated until the entire utterance has been processed and spectral magnitude data has been obtained to allow for estimation of the energy levels associated with the entire utterance, thereby enabling normalization, equalization, and reduction of the noise associated with each sample in the frequency domain.

As one can ascertain, many of the processing details can be modified to suit particular application without affecting the scope of the present application. For example, the present system could be implemented with alternative methods of establishing the noise floor or the blind deconvolution gain. Also, the preferred embodiment reads each input speech utterance from a digital file and writes the processed data to an output file, enabling the algorithm to employ multiple passes over the data. This file-to-file structure is not essential, and could be replaced with a design enabling processing with a fixed delay.

It should be understood that a person skilled in the art may make many variations and modifications to embodiments utilizing functionally equivalent elements to those described herein. For example, while a Hanning window has been used, it is contemplated that other windows might also be used including hamming, rectangular or bartlett windows. Any and all such variations or modifications, as well as others which may become apparent to those skilled in the art, are intended to be included within the scope of the invention as defined in the appended claims.

What is claimed is:

1. A method for combining noise suppression and channel equalization in a preprocessor for enhancing the quality of a noisy input voice signal comprising:

sampling said noisy voice signal at a predetermined sampling rate $f_s$;

segmenting said sampled voice signal into a plurality of frames;

transforming each of said frames into a magnitude and phase spectural sample representation as a function of a predetermined set of discrete frequencies f;

determining a noise threshold $N_f$ associated with each frequency f;

determining a channel frequency response $C_f$ associated with each frequency f according to said nose threshold $N_f$;

subtracting said noise threshold $N_f$ from each of the magnitudes of the spectral samples to provide a noise suppressed sample sequence;

applying blind deconvolution to said noise suppressed samples; and transforming said deconvolved noise suppressed sampled sequence to a temporal representation to provide a noise reduced output signal indicative of said input voice signal;

wherein said noise threshold $N_f$ of each frequency f is at least partially based upon data indicative of a spectral magnitude histogram.

2. The method according to claim 1, wherein the steps of:

determining said noise threshold $N_f$;

determining said channel frequency response $C_f$;

subtracting $N_f$ from each of said magnitudes; and performing blind deconvolution are repeated for each frequency within said set of discrete frequencies and each frame within said plurality of sampled speech frames.

3. The method according to claim 2, wherein the step of transforming each of said frames to a magnitude and phase representation as a function of frequency comprises performing a 1024-point fast Fourier transform (FFT) on each said frame to provide magnitude values $M_{ft}$ of said spectral samples where t represents the frame number (t=0,1, . . . , 511) and f represents a particular frequency within said set of discrete frequencies.

4. The method according to claim 3, wherein the step of transforming said deconvolved noise suppressed sample sequence to a temporal representation comprises performing a 1024-point inverse fast Fourier transform (IFFT).

5. The method according to claim 1, wherein the frequency resolution of spectral samples is no greater than 10 Hz.

6. The method according to claim 1, wherein the step of determining the noise threshold $N_f$ comprises generating a histogram of the spectral magnitudes for each frequency and determining the peak amplitude of said histogram at each frequency.

7. The method according to claim 1, wherein the step of subtracting $N_f$ from each of the magnitudes further comprises setting any negative values of said noise suppressed sample sequence to zero prior to the step of applying blind deconvolution.

8. A method for performing noise suppression and channel equalization of a noisy voice signal comprising the steps of:

sampling said noisy voice signal at a predetermined sampling rate $f_s$;

segmenting said sampled voice signal into a plurality of frames having a predetermined number of samples per frame, over a predetermined temporal window;

generating an N-point spectral sample representation of each of said sample signal frames;

determining the magnitude of each of said N-point spectral samples and generating a histogram of the energy associated with each of said N-point spectral samples at a particular frequency;

detecting a peak amplitude of said histogram which corresponds to a noise threshold $N_f$ associated with each said particular frequency;

determining a channel frequency response $C_f$ associated with each said particular frequency by determining a geometric mean over all said spectral samples having magnitudes exceeding said noise threshold $N_f$;

subtracting from each of the magnitudes of the N point spectral samples the noise threshold $N_f$ to provide a noise suppressed sample sequence;

applying blind deconvolution to said noise suppressed samples;

transforming said deconvolved noise suppressed sampled sequence to a temporal representation;

shifting said temporal sample sequence in time by a predetermined amount; and adding said time shifted temporal samples over a period corresponding to said predetermined temporal window to provide a suppressed noise voice signal.

9. The method according to claim 8, wherein the step of determining the magnitude of each of said N-point spectral samples comprises the step of converting each of said spectral samples from rectangular to polar coordinates.

10. The method according to claim 9, further comprising the step of converting said deconvolved noise suppressed sample sequence from polar to rectangular coordinates immediately before the step of performing said temporal transformation.

11. The method according to claim 10, wherein said step of segmenting said sampled voice signal into frames comprises forming a 1024 point hanning window.

12. The method according to claim 11, wherein the step of generating an N-point spectral representation further comprises performing a 1024 point fast Fourier transform of said framed samples.

13. The method according to claim 11, wherein the step of transforming said deconvolved noise suppressed sample sequence further comprises the step of performing a 1024 point inverse fast Fourier transform.

14. The method according to claim 11, further comprising the step of normalizing the magnitude of the sample spectral representation.

15. The method of claim 11, wherein said noisy input signal comprises stationary noise.

16. A pre-processor for use in a voice verification system for performing noise suppression and channel equalization of input speech utterances which have been sampled at a sampling rate $f_s$ comprising window means for converting each sampled speech utterance into a plurality of speech frames;

N-point Fourier transform means for converting each said speech frame into a spectral sequence representation;

means responsive to said Fourier transform means for converting each said spectral sequence to a polar coordinate representation, wherein each said sample in said spectral sequence has a corresponding magnitude $m_{ft}$ and phase;

histogram means for generating a histogram of each of said sample magnitudes associated with a frequency f and a corresponding frame window over said entire utterance;

threshold means responsive to said polar means for determining a peak amplitude of said histogram at a corresponding frequency, said peak amplitude corresponding to a corresponding noise threshold $N_f$;

means responsive to said noise threshold for determining a channel frequency response $C_f$ at each said frequency f;

means for subtracting from each said spectral sample sequence magnitude $m_{ft}$ the noise amplitude $N_f$ associated with said noise frequency f to provide a noise suppressed sample sequence;

filter means responsive to said noise suppressed sample sequence for performing blind deconvolution for providing a processed magnitude spectral sequence;

inverse polar means responsive to said processed magnitude spectral sequence for converting said magnitude from polar to rectangular coordinates;

inverse transform means responsive to said rectangular means for providing a temporal representation of said processed spectral magnitude signal sequence; and synthesis means responsive to said inverse transform means for time shifting and adding each of the magnitude samples corresponding to said window interval for providing an output sample sequence for further processing by the verifier.

17. The preprocessor according to claim 16, wherein said window means comprises a 1024 point hanning window having ½ overlap.

18. The preprocessor according to claim 17, wherein the sampling rate of said sampled input speech utterances is 8 kHz.

19. The preprocessor according to claim 16, wherein said N-point Fourier transform means comprises a 1024 point fast Fourier transform.

20. The preprocessor according to claim 16, wherein said inverse transform means comprises a 1024 point inverse fast Fourier transform.

21. The preprocessor according to claim 16, wherein said filter means for performing blind deconvolution has a trapezoidal shaped window.

22. The preprocessor according to claim 21, wherein the frequency response $C_f$ is equal to:

$$C_f = \exp\left(\frac{1}{|m_{ft} > N_f|} \sum_{m_{ft} > N_f} \log m_{ft}\right).$$

23. In a speech verification system for verifying a voice of a user including means for prompting said user to speak in a limited vocabulary comprising an at least one utterance, sampling means for sampling said at least one utterance at a predetermined rate to provide a sampled input signal, verification means for comparing a preprocessed signal indicative of said at least one speech utterance with a prestored voice model of said user to authenticate said user, a method for preprocessing said sampled input signal indicative of said speech utterance for output to said verification means comprising the steps of:

converting said sampled input signal into a plurality of speech frames having a predetermined number of samples per frame;

processing said plurality of speech frames by sequentially performing N-point discrete Fourier transform on each said speech frame to provide a spectral sample sequence corresponding to a given frame;

determining the magnitudes of said spectral sample sequence and generating a histogram of the magnitude as a function of a discrete set of frequencies over all samples comprising the speech utterance;

detecting a peak amplitude associated with said histogram over said entire utterance to determine a noise amplitude $N_f$ at each corresponding frequency within the discrete set of frequencies;

determining a channel frequency response $C_f$ based on said detected noise amplitude $N_f$;

subtracting from the magnitude of each said spectral sample said noise amplitude $N_f$ and setting any negative results of said subtraction to zero, to provide a subtracted sample sequence;

filtering said subtracted sample sequence via a blind deconvolution filter having a frequency response inversely proportional to the channel frequency response $C_f$ to provide a channel equalized spectral sample sequence;

converting said channel equalized spectral sample sequence to a temporal sequence by performing an N point inverse discrete Fourier transform; and accumulating and shifting said temporal sequence according to the frame period to provide said preprocessed signal for input to said verification system.

24. The method according to claim 23, wherein the step of determining the frequency response $C_f$ comprises determining a geometric mean of each of the samples over the utterance of those magnitudes at frequency f exceeding said noise amplitude $N_f$.

25. The method according to claim 23, wherein said N-point discrete Fourier transform comprises a 1024 point FFT, wherein said N-point inverse discrete Fourier transform comprises a 1024 point IFFT, and wherein the step of converting said sampled input signal into a plurality of speech frames comprises filtering said sampled input signal using a hanning window with ½ overlap.

26. An apparatus for performing noise suppression and channel equalization of input speech utterances comprising:

fourier transform means for converting sampled speech frames into a spectural sequence representation of magnitude values corresponding to a predetermined set of frequencies;

noise suppression means responsive to said magnitude values for determining a noise component value associated with each frequency within said set of frequencies based on a probability density function of the magnitude values at each frequency and subtracting the noise component value from said magnitude values to produce a noise suppressed spectral sequence;

filter means responsive to said suppressed spectral sequence for performing channel equalization using blind deconvolution to provide a processed magnitude spectral sequence;

inverse fourier transform means responsive to said processed magnitude spectral sequence for transforming said processed magnitude spectral sequence into a temporal output sequence indicative of said input speech utterances having noise suppressed and channel equalized characteristics.

* * * * *